United States Patent [19]

Syvarth et al.

[11] Patent Number: 4,711,255

[45] Date of Patent: Dec. 8, 1987

[54] METHOD AND SYSTEM FOR EFFECTING SENSORY EVALUATION OF A SMOKING PRODUCT

[75] Inventors: Anne S. Syvarth, Kernersville; Harvey H. Gordin, Winston-Salem; Paul D. Early, Jr., Winston-Salem; Kathy A. Needs, Pfafftown; Thomas A. Perfetti, Winston-Salem, all of N.C.

[73] Assignee: R. J. Reynolds Tobacco Company, Winston-Salem, N.C.

[21] Appl. No.: 907,555

[22] Filed: Sep. 15, 1986

[51] Int. Cl.[4] ..... A24F 13/00

[52] U.S. Cl. ..... 131/330

[58] Field of Search ..... 131/328, 329, 330, 290

[56] References Cited

PUBLICATIONS

Margaret R. Savoca, Computer Applications in Descriptive Testing, Food Technology 38 (9), pp. 74–77 (1984).

J. X. Guinard, R. M. Pangborn and C. F. Shoemaker, Computerized Procedure for Time–Intensity Sensory Measurements, J. Food Science 50, pp. 543, 544 and 546 (1985).

Frank E. Resnik, William H. Danker and Frank L. Daylor, Jr., Flavor Evaluation of Cigarette Smoke Components, paper presented at Third World Tobacco Scientific Congress held Feb. 18–26, 1963 in Salisbury, Southern Rhodesia, pp. 522–533 in proceedings published by Mardon Printers Ltd., Salisbury Southern Rhodesia.

*Primary Examiner*—V. Millin

*Attorney, Agent, or Firm*—Herbert J. Bluhm

[57] ABSTRACT

A method and system for effecting sensory evaluations of smoking products are disclosed wherein a plurality of spaced points or segments are designated along an elongated body of smokable material and sensory evaluation panelists are requested to assign an intensity rating for one or more selected attributes as the fire cone reaches each of the spaced points or segments. In a preferred embodiment programmable computer means are employed to lead the sensory evaluation panelists through the evaluation procedure and to receive the assigned intensity ratings and other responses from the panelists.

14 Claims, 7 Drawing Figures

* PRODUCTS ARE SIGNIFICANTLY DIFFERENT AT $p \leq 0.05$, UNLESS OTHERWISE NOTED.

* PRODUCTS ARE SIGNIFICANTLY DIFFERENT AT $p \leq 0.05$.

* PRODUCTS ARE SIGNIFICANTLY DIFFERENT AT $p \leq 0.05$, UNLESS OTHERWISE NOTED.

METHOD AND SYSTEM FOR EFFECTING SENSORY EVALUATION OF A SMOKING PRODUCT

BACKGROUND OF THE INVENTION

This invention relates to the sensory evaluation of smoking products and particularly to products containing an elongated body of smokable material such as cigarettes, cigarillos and cigars.

In the development of smoking products intended for commercial production, it is customary to conduct sensory evaluations of such products during their development phase to determine whether or not the products possess those attributes which are desired by the consumers of the products. Among the sensory evaluations utilized are those performed by small panels of judges who are trained to characterize the attribute intensities of the products. Such sensory evaluations, known as descriptive testing, require the judges to apply uniform terms to describe the product and to be thoroughly familiar with sensory evaluation techniques.

Descriptive testing has heretofore involved the monadic evaluation of smoking products which are smoked ad lib by sensory judges or panelists who then indicate the intensity of one or more sensory attributes using an anchored, unstructured line scale. Such a testing technique provides information about the relative attribute intensity of each product evaluated but it does not provide any information concerning changes in attribute intensity as the product is consumed. For example, it is generally recognized that tobacco acts as a filtration medium for tobacco smoke. Thus, the composition of smoke reaching a smoker's mouth shortly after a cigarette is lit would be somewhat different from that entering the smoker's mouth near the end of the smoking process because the length of the unsmoked tobacco through which the smoke travels is decreasing as the smoking process proceeds. Smokers who base their evaluation of the intensity of a particular attribute on the first few puffs may reach a different conclusion than smokers who base their evaluation on the last few puffs.

Conventional sensory evaluation methods are also not entirely suitable for use with cigarettes or similar smoking products which have elongated bodies of smokable material that are not uniform throughout their length. This non-uniformity of the smokable material may be designed into the product by a particular manufacturing process such as that disclosed in U.S. Pat. No. 3,880,171 wherein two different types of smoking material are combined in a stratified arrangement. Disclosed in U.S. Pat. No. 3,902,504 is an "engineered" cigarette which includes a rod of smokable material having carbon filled paper incorporated therein in increasing amounts toward the mouth end of the cigarette. When smoking such nonuniform smoking products, it is apparent that the smoke composition and flavor effect delivered will depend in part on the nature of the smoking material that is undergoing combustion at that time. It follows that sensory evaluation of such nonuniform smoking products using conventional testing methods would fail to provide a complete picture of the sensory attributes associated with those products.

SUMMARY OF THE INVENTION

It is a principal object of this invention to provide a sensory evaluation method for smoking products that is capable of rendering a more comprehensive understanding of the overall performance of a product with regard to particular attributes that are to be rated by a sensory evaluation panelist.

An additional object of this invention is to provide a sensory evaluation method for an elongated body of smokable material which permits attribute intensity ratings to be made at specified locations along its length to determine variations in particular attributes during the smoking process.

Other objects will become apparent from the description which follows.

We have found that a sensory evaluation method for smoking products which monitors selected attributes during the entire smoking process provides very useful results. This is accomplished by having a panelist make repeated evaluations of a particular attribute as a product is being smoked. This permits a sensory evaluation analyst to examine variations in a selected attribute as the smoking process proceeds thereby providing a more complete evaluation of the performance of a smoking product. This method is particularly suited to the evaluation of cigarettes.

The presently disclosed sensory evaluation method involves designating a plurality of spaced points along the elongated body of smokable material (e.g., the tobacco rod of a cigarette) and having a sensory evaluation panelist assign perceived intensity ratings to a particular attribute during the smoking process as the fire cone consuming the elongated body of smokable material reaches each of the spaced points. This results in a plurality of intensity ratings for a particular attribute which can be plotted as a function of the location of the spaced points designated along the elongated body of smokable material to provide a useful basis for analyzing the performance of different smoking products.

It has been further found that the reliability of the present sensory evaluation method is significantly improved by employing programmable computer means to communicate with panelists and to serve as a data collection device. Thus, a computer provided with means for generating test instructions and prompts to a sensory evaluation panelist as well as with means for receiving responses from the panelist leads the panelist through the entire smoking procedure and processes the sensory evaluation ratings received in a predetermined manner for later presentation. The computer eliminates the distractive influence of a written ballot and also serves to minimize anticipation of the directional movement of the intensity rating of a particular attribute as the product is being smoked. The computer means can be programmed to generate an anchored, unstructured line scale that is typically used in descriptive testing. The computer programs can also be designed to time activities within the sensory evaluation test sequence. It is apparent, therefore, that the use of computer means in connection with the present sensory evaluation method greatly enhances the capabilities and efficiency of the method.

DETAILED DESCRIPTION OF THE PREFERRED EMBODIMENT

Figure 1:
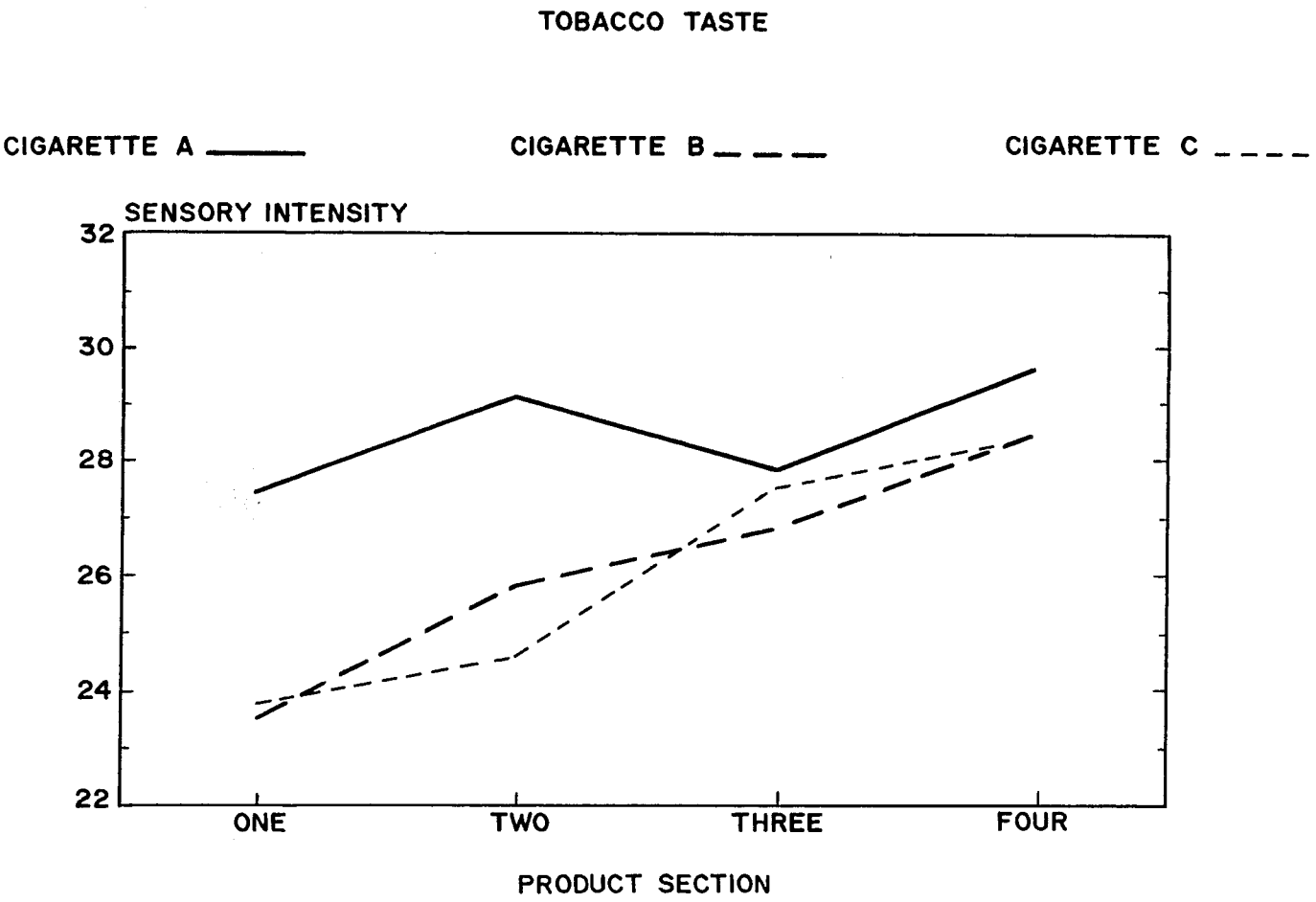
FIGS. 1, 2, 3 and 4 are graphic representations of the intensity variations of certain attributes perceived by a trained panel during the smoking process of different cigarettes.

This invention will now be described in more detail with reference to cigarettes as the smoking product. It will be understood, however, that the invention can be used for evaluating other smoking products having an elongated body of smokable material such as cigars, cigarillos and the like. Thus, the following description is not intended to be limiting.

The present invention is based on descriptive methodology as a technique for effecting sensory evaluation of a product. In descriptive methodology panel members are asked to evaluate one or more attributes or characteristics by assigning to each attribute a rating that reflects the intensity of the attribute or characteristic as perceived by the panelist. The application of descriptive methodology to sensory evaluation of cigarettes poses a problem in that some of the attributes typically evaluated are not constant during the smoking process. Thus, an attribute rating assigned by a panelist will be influenced by the particular point in the smoking process at which the evaluation is made. We have discovered that a more complete sensory evaluation of a cigarette can be obtained by including evaluations of one or more attributes repeatedly made during the smoking process. This is accomplished by designating a plurality of spaced points along the elongated body of smokable material and having the panelist who is smoking the cigarette assign an intensity rating for each attribute as the fire cone reaches each of the designated points along the elongated body of smokable material. A comparison of the perceived intensity ratings assigned at each designated point for a given attribute will indicate how the intensity of that attribute varies during the course of smoking the cigarette. Preferably, the intensity ratings for a particular attribute may be plotted on a graph or arranged in some other suitable manner so that the intensity variations can be analyzed or directly compared with ratings similarly obtained for other cigarettes.

The number of intensity ratings obtained for each attribute during the smoking of a cigarette will depend on the physical and smoking characteristics of the cigarette as well as on the sensory evaluation that is desired. Nevertheless, a reliable sensory evaluation should include at least three intensity ratings for each attribute at specified locations along the length of the cigarette. For a typical 85 mm. filter cigarette having a circumference of about 25 mm., from 4 to 8 evaluation points or segments should preferably be designated along the elongated body of smoking material. This permits evaluation of a significant number of attributes without placing undue burdens on sensory judges. Longer cigarettes may have more than 8 evaluation points designated but should have a minimum of three points or segments designated. Shorter cigarettes may also be evaluated but the elongated body of smoking material should be at least 20 mm. in length to provide sufficient spacing for three designated evaluation points. Other physical characteristics are not critical and the present method is applicable to both filter and nonfilter cigarettes having various circumferences, lengths, cigarette paper, tobacco blends, etc. Cigarettes provided with air dilution means may also be evaluated using this method.

Figure 2:
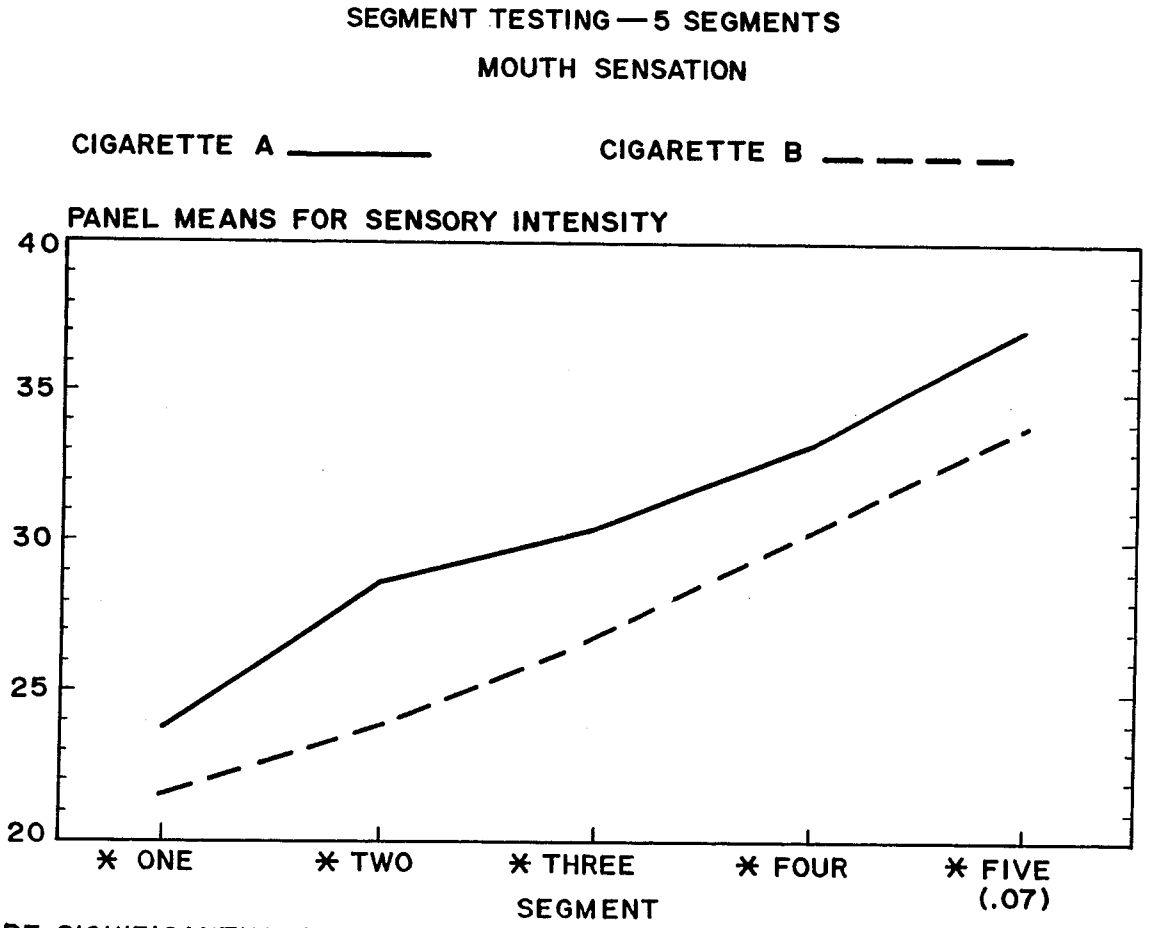
Figure 3:
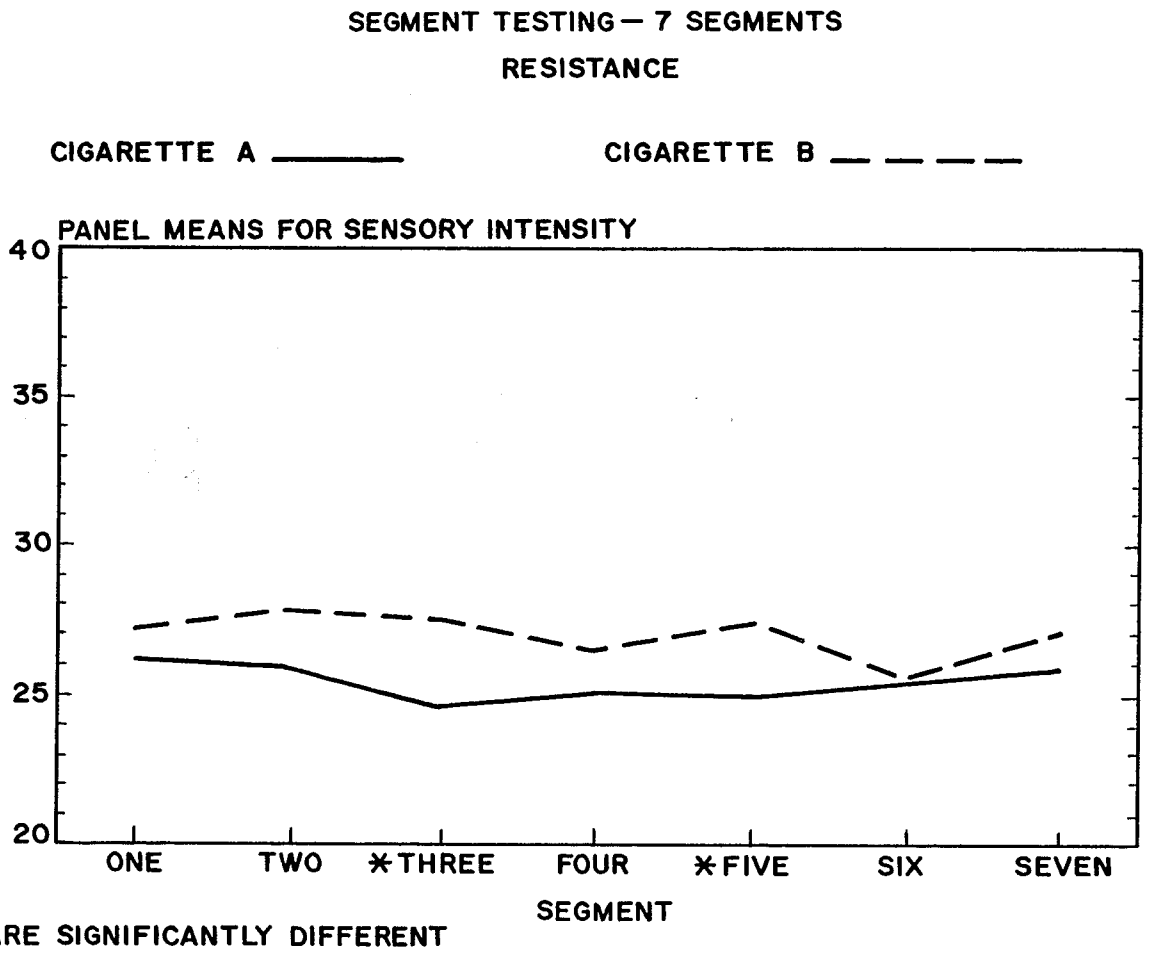
Figure 4:
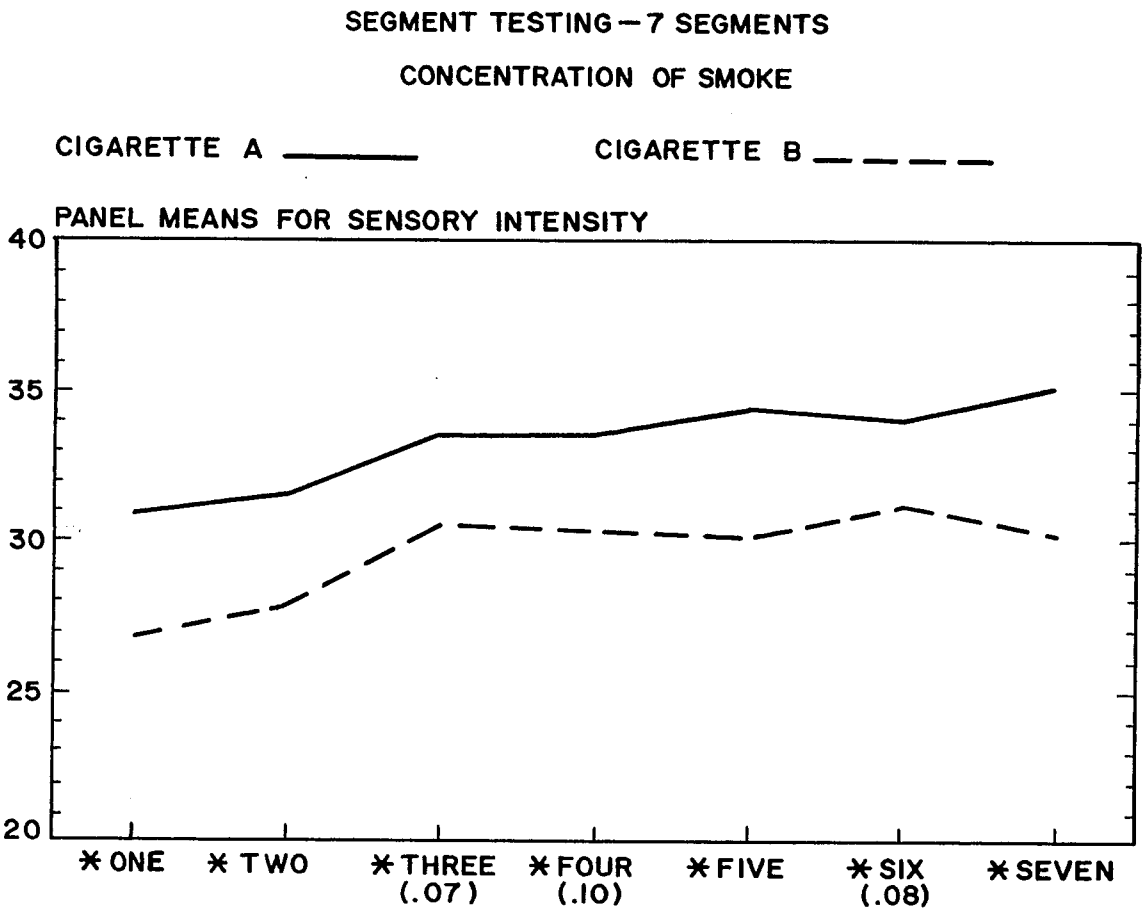

Typical graphical presentations of sensory evaluations conducted in accordance with this invention are shown in FIGS. 1 through 4. The evaluation of tobacco taste for three different cigarettes based on four designated segments is shown in FIG. 1 wherein cigarette A was found to deliver more tobacco taste than cigarette B or C. Sensory evaluation of mouth sensation for two different commercially available cigarettes is depicted in FIG. 2 based on five designated evaluation points along the tobacco rod of each cigarette. In this case it will be seen that the perceived intensity for each attribute is significantly higher for cigarette A throughout the smoking process. Shown in FIGS. 3 and 4 are the sensory evaluation results for resistance to draw and concentration of smoke, respectively, for two different commercial cigarettes based on seven designated evaluation points. In this case cigarette A was adjudged to have a slightly lower resistance to draw but a significantly higher concentration of smoke throughout the smoking process. Other smoking attributes such as menthol flavor, fruity flavor, sweetness, cooling sensation, drying sensation, throat impact, etc. can be similarly evaluated.

The points at which a panelist is to make an evaluation of a particular attribute may be designated by placing marks on the tobacco rod at appropriately spaced distances. The marks need not be spaced at equal distances so long as each cigarette is marked in the same manner. Usually, however, the marks are applied at points which are equally spaced so that the tobacco rod is designated as having the desired number of segments of identical length. If desired, the length of the first segment (i.e., the segment that is lighted first) may be slightly greater to allow for the length of tobacco rod that is consumed by the lighting process. The panelist is instructed to perform the desired evaluation as the fire cone of the burning tobacco rod reaches each of the designated points or segments. If several different attributes are being evaluated, panelists would be required to complete their evaluation of each attribute before the fire cone reaches the next designated point or segment. Suitable means (e.g., ballots, data sheets, etc.) must, of course, be provided for the panelist to record the intensity rating assigned to each attribute in each designated segment of the tobacco rod.

The sensory evaluation data recorded by the judges on the panel are preferably combined so that an average or mean value may be obtained for each attribute evaluated. The average attribute ratings may then be graphically displayed or arranged in alternative formats as desired. Statistical treatment of the data may also be accomplished in accordance with standard well known methods.

Although the sensory evaluation data obtained in accordance with the present invention provide very useful information, it should be recognized that reliability and reproducibility of the data are directly related to the consistent performance of the panelists. It is, therefore, important that panelists be selected on the basis of their ability to distinguish consistently between different intensity levels for the attributes being evaluated. This can be accomplished by screening panelists who evaluate cigarettes that are designed to exhibit smoking characteristics that represent extreme as well as intermediate intensity levels for the attributes of interest. In this way the performance of each panelist can be monitored to see how well and how consistently intensity variations in the attributes of interest are discerned by the panelist.

It has been found that the practice of this invention is greatly facilitated by employing computer means for communicating instructions and prompts to and receiving responses from the members of the sensory evaluation panel. It is preferred that the computer means include touch input capability for receiving responses from the panelists. Such a capability not only eliminates the need for recording evaluations on a written ballot but also removes a potential directional influence on panelists due to the visual availability of previously recorded ratings or scores for the cigarette being smoked. Computer systems for receiving responses or input from an operator are commercially available and include, for example, a touch sensitive computer monitor screen, a keyboard or similar means for positioning a cursor on the monitor screen and a bit pad with stylus. The computer means also allows a predetermined sequence or routing to be presented to the panelist and may include pauses in the routine where appropriate. Suitable computer programs for leading a sensory evaluation panelist through the smoking process can take various forms. For example, a typical program would present initial instructions to the panelist defining the attributes to be evaluated and the number of repeat evaluations. Prompts would appear on the monitor screen requesting the panelist to enter the code numbers of the cigarettes to be evaluated, the name or identification number of the panelist and any other desired information such as date, time, test code number, etc. before the panelist is instructed to begin the smoking process. At the appropriate point in the program a rating scale for a particular attribute appears on the monitor screen and the panelist is requested to enter an intensity rating for that attribute on the rating scale. The data entered by the panelist would be stored by the computer for processing in accordance with separate data manipulation sequences programmed into the computer.

Figure 5:
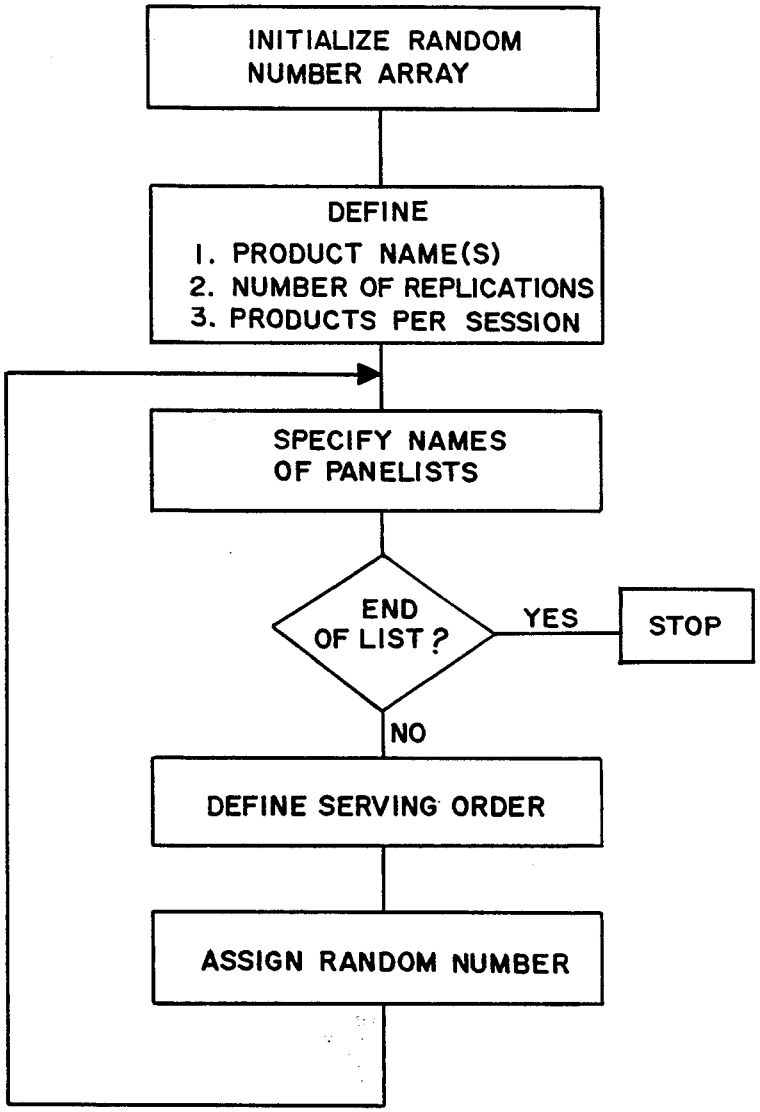
FIGS. 5, 6 and 7 are schematic representations of computer programs which are useful in adapting the presently disclosed sensory evaluation method to a computerized sensory evaluation program.
Figure 6:
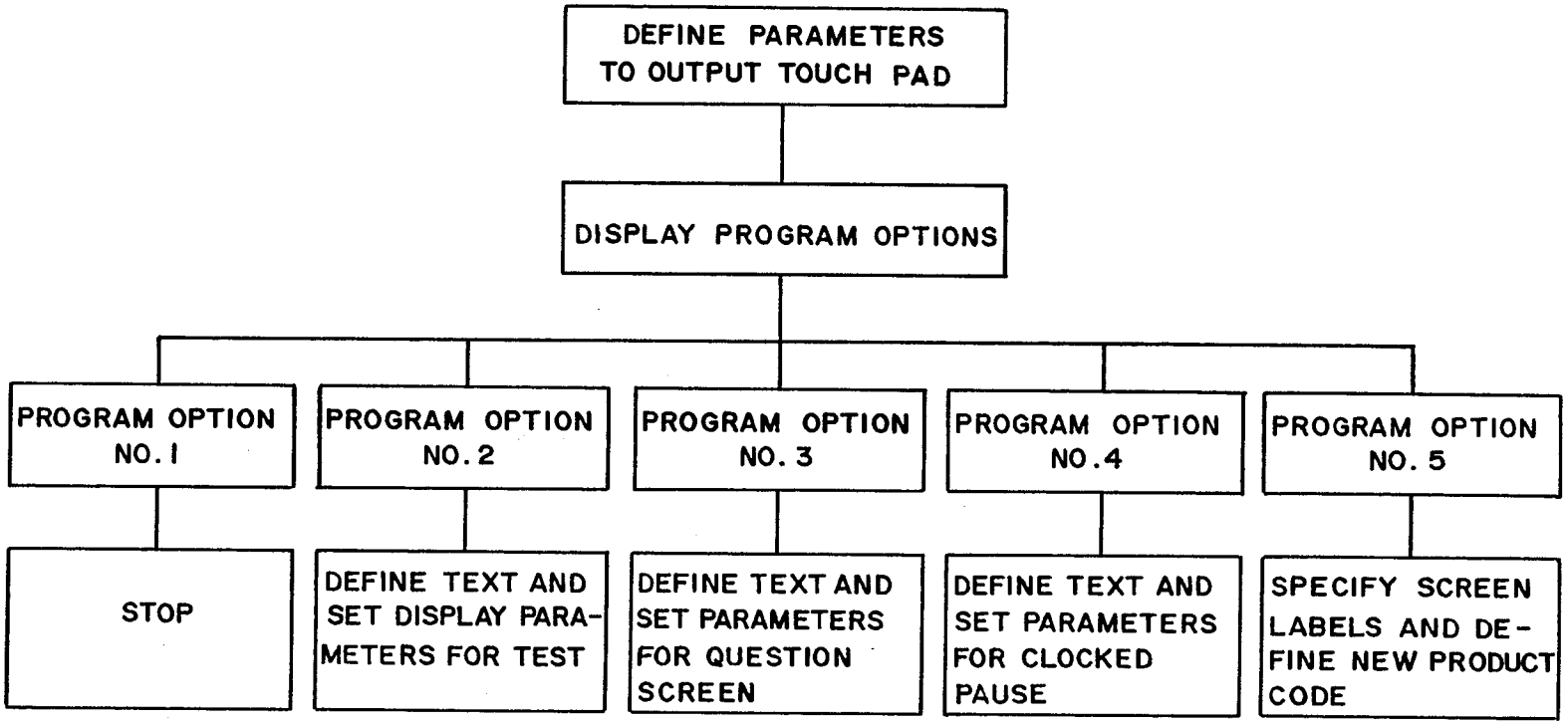
Figure 7:
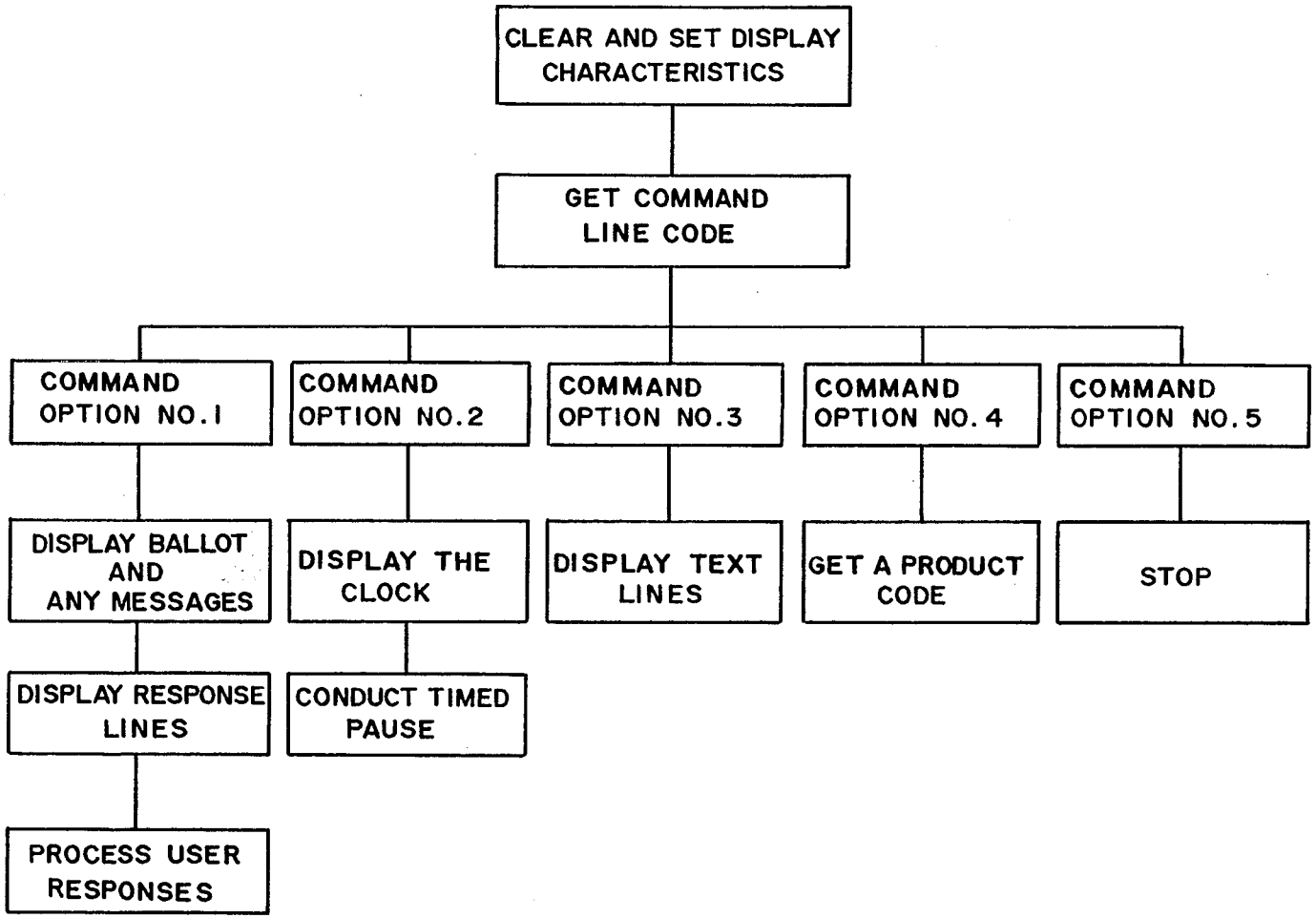

Shown in FIGS. 5, 6 and 7 are schematic flow diagrams setting forth typical computer programming strategy that can be used in the practice of this invention. The sequence of steps outlined in FIGS. 5 and 6 is designed to receive information from the sensory evaluation analyst or the director of the sensory evaluation program before each product test is conducted. The information supplied for each product test includes in Program A (FIG. 5), for example, the product name or code, the number of replications, the number of products evaluated per session, names of the panelists selected to evaluate the product(s), the order in which the products are served to the panelists and any other information that may be needed for a particular product test.

Program B (FIG. 6) permits the designation of program options to be used for a particular product test. Thus, the director of the sensory evaluation program can enter into Program B any desired text for instructions, questions, prompts, messages to the panelist, etc. as well as any desired parameters for different parts of the test. Among the parameters which may be specified are the attributes to be evaluated, the number of intensity rating scales that are to appear on each screen, the length of the clocked pauses in the test sequence and when particular instructions are to be presented on screen. In specifying the program options for a particular product test, only those options which are desired for the test need be designated. For example, program option No. 4 need not be designated if a timed pause in the test sequence is not required. Included in the basic program are instructions for activating the means for receiving responses from panelists (e.g., a touch sensitive computer screen, keyboard for moving a cursor, bit pad with stylus, etc.) at each point in the test sequence where panelist responses are required.

Shown in FIG. 7 is a general outline of the computer program which conducts the sensory evaluation procedure with each panelist who is evaluating a particular smoking product. Program C is designed to consult the data and information contained in the files established by Programs A and B so that the sensory evaluation procedure is conducted in accordance with specifications set forth by the sensory evaluation analyst or director of the product test. Thus, the actual evaluation procedure that is conducted by Program C will depend on the information previously entered in the appropriate data files via Programs A and B. For example, the number of times that a displayed ballot and associated prompts are repeated in the evaluation procedure will be determined by the number of segments which have been designated along the elongated body of smokable material for that particular test. Similarly, the text of any special instructions displayed to a panelist will be derived from the information supplied by a data file created under Program B.

From the foregoing description it will be seen that Program A deals generally with panelist information while Program B involves experimental directives for conducting the desired sensory evaluation. Program C relates to the actual communication process between the programmed computer means and the panelist using specific information available from data files previously established under Programs A and B. It is apparent that other computer programming strategies could be employed for adapting the sensory evaluation method disclosed herein to a computerized sensory evaluation program.

What is claimed is:

1. A method for effecting sensory evaluation of a smoking product having an end adapted for insertion into the mouth of a smoker and containing an elongated body of smokable material that is gradually consumed by a fire cone which moves toward the mouth end during the smoking process, said method comprising the steps of (a) providing means for communicating instructions and prompts to a sensory evaluation panelist and for receiving responses from said panelist, (b) presenting said sensory evaluation panelist with a smoking product to be smoked and specifying an attribute to be evaluated, (c) designating a plurality of spaced points along the elongated body of smokable material, (d) instructing said sensory evaluation panelist to assign a rating to said attribute as the fire cone reaches each of said spaced points along the elongated body of smokable material, said rating to be assigned reflecting the intensity of the attribute perceived by said panelist, (e) receiving a sensory evaluation rating from said panelist for each of said spaced points reflecting the intensity of said attribute perceived by the panelist at each point and (f) arranging the sensory evaluation ratings received from said panelist to show any variation in the perceived intensity of said attribute during the smoking process.

2. The method of claim 1 wherein at least three points are designated along the elongated body of smokable material for sensory evaluation of the attribute specified.

3. The method of claim 2 wherein the spaced points designated comprise a plurality of segments of predetermined length along the elongated body of smokable material.

4. The method of claim 3 wherein a plurality of attributes are specified for evaluation and a sensory evaluation rating for each attribute is made as the fire cone moves through each segment designated along the elongated body of smokable material.

5. The method of claim 2 wherein said smoking product comprises a cigarette.

6. The method of claim 1, 2, 3, 4 or 5 wherein said means for communicating instructions and prompts to and for receiving responses from a sensory evaluation panelist comprises a computer and a display screen associated therewith provided with a program that is designed to lead the sensory evaluation panelist through said smoking process.

7. The method of claim 6 wherein the responses from the sensory evaluation panelist are received by a stimulus brought into contact with or close proximity to a portion of said display screen.

8. A method for effecting sensory evaluation of a smoking product having an end adapted for insertion into the mouth of a smoker and containing an elongated body of smokable material that is gradually consumed by a fire cone which moves toward the mouth end during the smoking process, said method comprising the steps of (a) providing a computer and associated display screen having touch sensitive capabilities for communicating instructions and prompts to a sensory evaluation panelist and for receiving responses from said panelist by a stimulus brought into contact with or close proximity to a portion of the display screen, (b) programming said computer with specific routines and information to generate a predetermined sequence of instructions and prompts on said display screen and to receive responses from said sensory evaluation panelist via the touch sensitive display screen, (c) presenting said sensory evaluation panelist with a smoking product to be smoked and specifying an attribute to be evaluated, (d) designating a plurality of segments of predetermined lengths along the elongated body of smokable material, (e) instructing said sensory evaluation panelist to assign a rating to said attribute as the fire cone moves through each segment designated along said elongated body of smokable material, said rating to be assigned reflecting the intensity of the attribute perceived by said panelist, (f) receiving a sensory evaluation rating from said panelist for each of said segments reflecting the intensity of said attribute perceived by the panelist as the fire cone moves through each segment and (g) arranging the sensory evaluation ratings received from said panelist to show any variation in the perceived intensity of said attribute during the smoking process.

9. The method of claim 8 wherein at least three segments are designated along the elongated body of smokable material for sensory evaluation of the attribute specified.

10. The method of claim 9 wherein a plurality of attributes are specified for evaluation and a sensory evaluation rating for each attribute is made as the fire cone moves through each of said segments designated along the elongated body of smokable material.

11. The method of claim 10 wherein said smoking product comprises a cigarette.

12. The method of claim 8, 9, 10 or 11 wherein said smoking product is presented to a plurality of sensory evaluation panelists and the sensory evaluation ratings received from said panelists are combined and averaged.

13. A system for conducting sensory evaluation of a smoking product having an end adapted for insertion into the mouth of a smoker and containing an elongated body of smokable material that is gradually consumed by a fire cone which moves toward the mouth end during the smoking process, said system comprising in combination (a) programmable computer means, (b) a monitor associated with said computer means and including a display screen that is responsive to activating means capable of indicating a sensory evaluation rating directly on said display screen, (c) means for providing said computer means with programming information designed to establish a sensory evaluation procedure for evaluating a designated attribute of said smoking product at a plurality of spaced points along said elongated body of smokable material, (d) means for generating on said display screen a series of instructions and prompts reflecting said programming information provided to said computer means and designed to lead a sensory evaluation panelist through said smoking process and to obtain from said panelist via said activating means a sensory evaluation rating for said designated attribute at each of said plurality of spaced points along said elongated body of smokable material and (e) means for recording the sensory evaluation ratings obtained from said sensory evaluation panelist that are indicated on said display screen in response to said activating means.

14. The system of claim 13 wherein said monitor and said display screen are responsive to activating means which comprises a stimulus brought into contact with or close proximity to a portion of the display screen.

* * * * *